United States Patent [19]

Shippey

[11] 4,065,313

[45] Dec. 27, 1977

[54] BLEACH-FIX REGENERATION MONITORING METHOD

[75] Inventor: Frederick Lee Shippey, Penfield, N.Y.

[73] Assignee: Eastman Kodak Company, Rochester, N.Y.

[21] Appl. No.: 695,273

[22] Filed: June 11, 1976

[51] Int. Cl.[2] ..... G03C 5/32

[52] U.S. Cl. ..... 96/60 BF

[58] Field of Search ..... 96/60, 60 BF, 50 A; 204/195

[56] References Cited

U.S. PATENT DOCUMENTS

| | | | |
|---|---|---|---|
| 3,709,796 | 1/1973 | King et al. | 204/195 E |
| 3,813,246 | 5/1974 | Schranz et al. | 96/60 BF |
| 3,839,162 | 10/1974 | Ammer | 204/195 R |
| 3,865,708 | 2/1975 | Light | 204/195 H |
| 3,879,203 | 4/1975 | Schranz et al. | 96/60 BF |
| 3,907,568 | 9/1975 | Shirasu et al. | 96/50 A |
| 3,964,988 | 6/1976 | Riseman et al. | 204/195 M |

*Primary Examiner*—Mary F. Kelley
*Attorney, Agent, or Firm*—T. N. Dahl

[57] ABSTRACT

A monitoring technique for use in the regeneration of spent bleach-fix solution containing silver ion and ferrous ion resulting from photographic processing. Regeneration comprises first treating the spent solution with elemental iron to reduce and chemically replace silver ion, and thereafter dispersing an oxidizing agent throughout the silver-free solution to convert ferrous ion to ferric ion. Exhaustion of the elemental iron in the silver replacement step or insufficient oxidation in the ferrous-ferric conversion step are electrochemically detected by comparison of the half-cell potential of a reference solution drawn from the bleach-fix solution in a region of the regenerative cycle where the solution is substantially insensitive to the exhaustion of the elemental iron and insufficient oxidation. Further provision of a continuously flushing reference solution provides longterm accuracy of the electrochemical monitoring method.

7 Claims, 4 Drawing Figures

BLEACH-FIX REGENERATION MONITORING METHOD

BACKGROUND OF THE INVENTION

1. Field of the Invention

This invention relates to the monitoring of a photographic bleach-fix regeneration cycle. In particular, it relates to the use of an electrochemical cell to sense — and produce voltaic output based upon — the electrochemical activity of ferrous and ferric ions in a sample solution compared to the activity of those ions in a reference solution.

2. Description of the Prior Art

Combined bleach-fix solutions are employed in processing silver halide photographic materials to accomplish bleaching and fixing in one step. These solutions incorporate a bleaching agent to oxidize the metallic silver in photographic elements to a soluble form, and a fixing agent to dissolve undeveloped silver halide and the silver salts formed by the action of the bleaching agent. Of particular importance — because of their stability and their ability to achieve excellent results — are bleach-fix solutions in which the bleaching agent is a ferric complex of an aminopolycarboxylic acid, and the fixing agent is a thiosulfate. Illustrative examples of aminopolycarboxylic acids can be found in U.S. Pat. No. 3,634,088 issued to Austin C. Cooley on Jan. 11, 1972. Ferric ion in such complexes converts metallic silver to ionic silver and is reduced thereby to ferrous ion.

So that spent bleach-fix solutions — where the bleaching agent is a ferric complex of an aminopolycarboxylic acid — containing ferrous ion and silver ion, may be restored to their original bleaching capability for reuse in the bleach-fix step of photographic processing, they are subjected to a regenerative treatment such as described in the aforementioned U.S. Pat. No. 3,634,088. In the first step, the solution to be regenerated is passed through a recovery vessel in which silver ion in the solution is chemically replaced by reduction using elemental iron (in a form such as steel wool, iron screen, iron flakes, and the like). The reaction giving rise to silver replacement is $$Fe^{\circ} + 2\,Ag^{+} \rightarrow Fe^{+2} + 2\,Ag^{\circ}\downarrow \qquad \text{I}$$

silver being collected as a precipitate within the vessel. Concurrently, ferric ions (which are present in the spent solution because the bleaching agent is typically supplied in excess) react with the metallic iron within the recovery vessel to form ferrous ions by the following mechanism:

$$Fe^{\circ} + 2\,Fe^{+3} \rightarrow 3\,Fe^{+2} \qquad \text{II}$$

The iron, of course, is exhaustible and demands eventual replacement. Otherwise collected silver is redissolved by ferric ions, and subsequently lost along with silver ions already in the solution, at great cost to the user. Precisely when the elemental iron is depleted may be estimated from the experience of previously exhausted recovery vessels. Or, one may observe a color change (going toward red) in the solution discharging from the recovery vessel, indicating the passage of ferric ions; had the elemental iron not been exhausted, ferric ions would have been reduced to ferrous ion (colorless or pale green in solution color). Both methods of detecting iron exhaustion are untimely, inaccurate and require a significant amount of personnel attention.

Because some lapse in time in discovering the exhaustion of the elemental iron is inevitable, one or more standby recovery vessels between the first vessel and the oxidation step (described below) are desirable. As the steel wool in the first vessel becomes exhausted, the unit next in line takes over. This procedure does avoid the loss of valuable silver; it regrettably does not provide an indication of when the first unit is spent. Until such indication is otherwise provided, silver replacement accomplished in the first unit is both reversed (by the dissolution of silver therein with ferric ions in the solution), and unnecessarily repeated by the standby unit next in line.

Whether one or more silver recovery vessels are employed, the inability to detect elemental iron exhaustion persists.

Step two in the bleach-fix regenerative cycle comprises treating the silver-free solution with an oxidizing agent, such as oxygen, halogen and the like, to convert ferrous ions therein to ferric ions, after which the ferric ion rich solution (to which various bleach-fix addenda have been added to compensate for dilution) is suitable for reuse in the bleach-fix processing region. Within the oxidizing region, unhindered supply of oxidising agent is essential. Nevertheless, experience has taught that the supply of oxidizing agent is often interrupted. For example, when air is employed as the oxidizing agent (as described in U.S. Pat. No. 3,634,088), it can be uniformly and rapidly bubbled into the solution through a porous head or sparger. If — as they often do — the sparger pores become plugged or the air compressor fails, curtailing the flow of air, too few ferrous ions in solution are oxidized to ferric ions. Spargers can also disintegrate. Although permitting adequate flow of air, this creates oversize bubbles with insufficient interfacial contact area between the air and the solution — again causing insufficient oxidation. Early detection of either situation is difficult. Solution color, based on the predominance of either ferric or ferrous ions in the solution discharging from the oxidizing region, is, at best, a belated and poor indicator of insufficient oxidation.

A reliable method for accurately detecting when either the steel wool in a recovery vessel exhausts or insufficient ferrous-ferric oxidation occurs, entails the use of a conventional electrochemical sensing cell. The cell, which is responsive to the ratio of ferric to ferrous ions in the solution, senses and presents a display relating to changes of that ratio as either of the aforementioned problems are encountered.

The voltaic output of an electrochemical cell is derived from a comparison of the potentials of two adjacent half-cells. One half-cell is the sample solution to be measured; the other is a reference and comprises standardized solution of known or constant half-cell potential. The half-cells are in electrical communication with each other in one path by means of wire joining a sensing electrode in each solution. A second path of electrical communication is provided by a small aperture or sintered plug in a partition separating the solutions. Electrochemical sensing is well known to the art. In this regard, ferrous and ferric ions are referred to as an ion couple or redox pair. The terms half-cell, half-cell (redox) potential are founded in a mathematical relationship known as the Nernst equation for a half-cell reaction. A fuller understanding of these electrochemical terms can be found in U.S. Pat. No. 3,839,043 issued on Oct. 1, 1974 to W. Hunicke et al; Electro Chemical Science by Bockris and Drazic (Barnes & Noble, 1972); Introduction to Organic Electrochemistry by RiFi and Covitz (Marcel Dekker, Inc., New York 1974); and Orion Research Newsletter/Specific Ion Electrode Technology, Volume IV, Numbers 3 & 4 (1972, Orion Research, Inc.)

Commercially available electrochemical sensing devices provide a reference half-cell (including reference solution and electrode) but require that the user complete the cell by supplying sample solution in which to immerse an exposed test electrode. These devices are unfortunately expensive. Cost disadvantage, moreover, is aggravated by the tendency of ions to drift through the aperture or plug in the partition separating the half-cell solutions. Such drift occurs generally from regions of high concentration to low concentration causing the standardized reference solution to depart from its known or constant half-cell potential. Once more, even after such ionic drift, there continues to be a voltaic output from the cell which in and of itself does not forewarn the user of the inherent inaccuracy of such continued output. Eventually, a replacement unit with a new reference solution must be provided. In retrospect, it appears that the use of such an electrochemical cell is expensive in its equipment aspects, and gives rise to operating inaccuracies (stemming from the continued use of a unit having a reference solution of unknown half-cell potential).

Employing an electrochemical cell to sense ferrous-ferric ion ratios, nevertheless, is an attractive method of monitoring a bleach-fix regeneration cycle for problem detection. The monitoring method embodying the invention implements the electrochemical sensing principle and, moreover, avoids the expense associated with reference half-cells in commercially available electrochemical cells. The invention also provides in one embodiment a monitoring method which, though permitting the drift of ions between the sample solution and the reference solution is immunized against loss of constant half-cell potential normally caused by such drifting ions.

SUMMARY OF THE INVENTION

In a process for regenerating spent bleach-fix solutions, the problems of elemental iron exhaustion in a first silver replacement step or insufficient oxidation in a ferrous-ferric conversion step are quickly and reliably detected. To this end, the invention proposes the use, in an electrochemical cell, of a reference solution comprising the above spent bleach-fix solution in a region of the regenerative cycle which is substantially insensitive to the ferrous-ferric ion fluctuations occasioned by the problem being detected. That is, an electrochemical monitoring method is proposed whereby the half-cell potential of the ferrous-ferric ion couple in a sample solution drawn from either the first silver replacement step or the oxidation step, is electrochemically compared with the half-cell potential of the same ion couple in a reference solution drawn from a region in the cycle which does not immediately respond to the onset of either problem. Suitable reference solutions include for example, the effluent from a bleach-fix photographic processing step, or the effluent from a standby silver replacement step between the first silver replacement step and the oxidation step.

In a presently preferred embodiment, substantially constant half-cell potential of the reference solution is preserved, despite drift of ions between the reference solution and an adjacent sample solution, by drawing fresh bleach-fix solution from an insensitive region of the regenerative process as described, and flushing the drawn solution through a region of reference half-cell potential sensing. Long term accuracy of the method is thereby provided the user.

BRIEF DESCRIPTION OF THE DRAWINGS

The invention will be described with reference to the figures wherein.

DETAILED DESCRIPTION OF THE PREFERRED EMBODIMENTS

Figure 1:
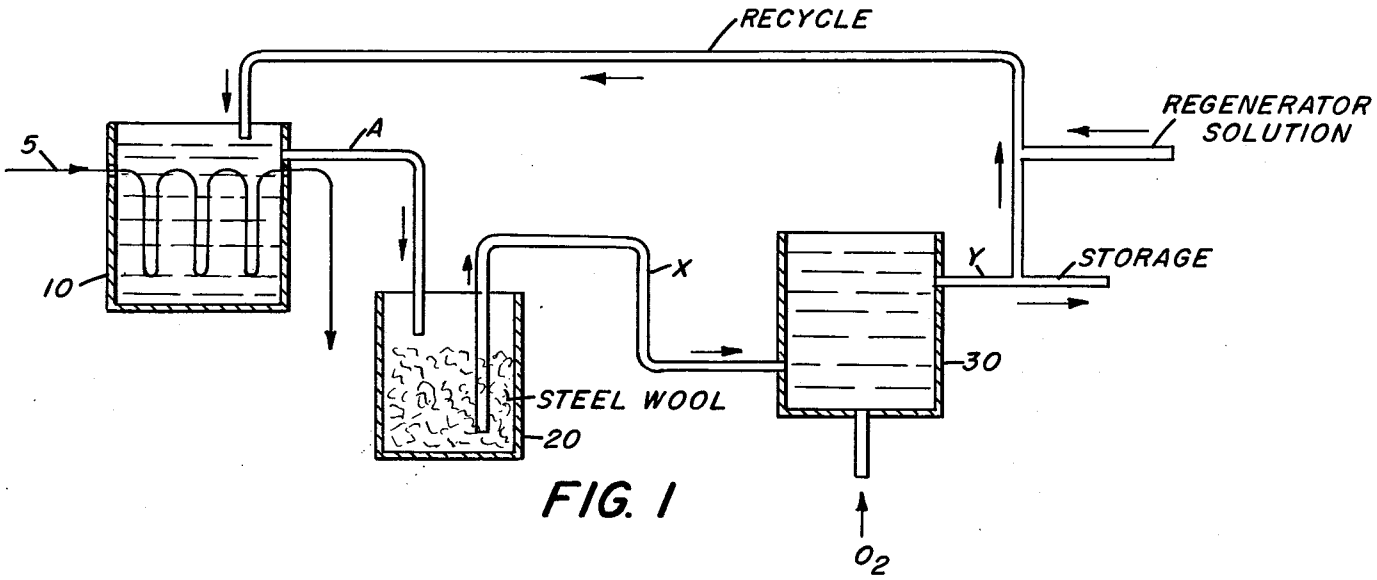
FIG. 1 is a schematic of a bleach-fix regenerative cycle having one silver replacement unit, and illustrating sampling and reference solution drawing points for use in accordance with the invention.
Figure 2:
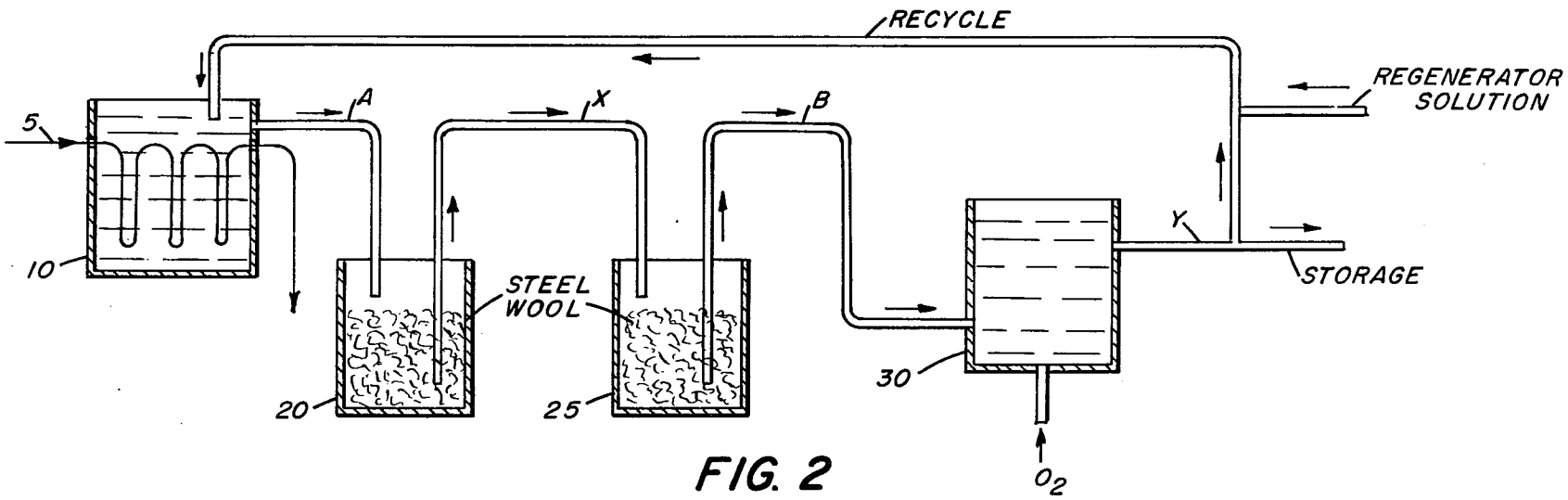
FIG. 2 is a schematic of the regenerative cycle in FIG. 1 showing both a standby silver replacement unit and an additional reference solution drawing point for use in accordance with the invention.

The regeneration of a used bleach-fix solution where the bleaching agent is a ferric salt of an amino polycarboxylic acid and the spent solution comprises silver ion and ferrous ion, may be carried out in a number of manners for purposes of the invention. FIGS. 1 and 2, two of the more common techniques, illustrate the more important steps. In FIG. 1, developed photographic elements on a web 5, are passed through a bleach-fix processing tank 10 where silver is removed from the elements by the action of the bleach-fix solution as previously described. Thereafter the used solution is passed in series through a silver recovery vessel 20 for removal of silver, an oxidation tank 30 for conversion of ferrous ions in the solution to ferric ion. Regenerated solution Y, may now be either recycled with regenerator solution to bleach-fix tank 10 or stored as shown.

Photographic element, as used herein refers to any photographic material having one or more silver halide photosensitive layers. The support for such an element may be paper, film, metal, and the like.

In FIG. 2, a standby silver recovery vessel 25 is provided as a back-up vessel 20, in the event the elemental iron (steel wool) in the latter vessel becomes exhausted.

When inevitably the steel wool in recovery vessel 20 becomes exhausted, a change occurs in the ratio of ferric ion to ferrous ion in solution X discharging from the exhausted vessel 20 (FIGS. 1 and 2). In like manner, the occurrence of insufficient oxidation in oxidation tank 30, brings about a change in the ratio of the same ions in solution Y treated in the oxidation step. In accordance with the prior art, such ratio changes are measurable with an electrochemical cell incorporating a reference half-cell such as a calomel electrode having a specially provided standardized reference solution. As the invention now evidences, that kind of a reference solution is no longer required. In the monitoring method proposed by the invention, the prior art reference solution is replaced with the bleach-fix solution in the regenerative cycle other than solution X or Y, the problem solutions.

In departing from the prior art, recognition is made, with regard to the ratio of ferric to ferrous ions, that changes in such ratio occasioned by the problems of exhausted iron or insufficient oxidation are localized. That is to say, when solution X or Y exhibit a change in the ratio of ferric to ferrous ion, no corresponding change in such ratio is immediately experienced, for example, in either the bleach-fix solution overflowing process tank 10 (i.e., solution A as shown in FIGS. 1 and 2) or discharging from standby recovery vessel 25 (i.e., solution B as shown in FIG. 2). The substantial insensitivity of solutions A or B to exhausted iron source or insufficient oxidation, gives rise, therefore, to their use as reference solutions in an electrochemical cell as shown in FIG. 3.

Figure 3:
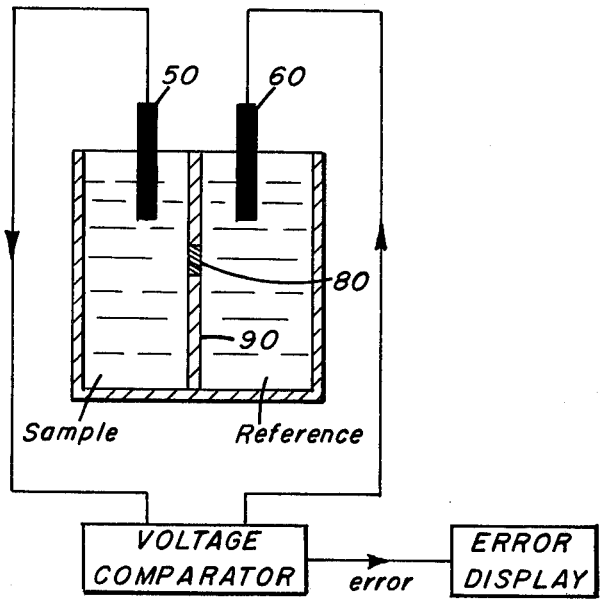
FIG. 3 is an electrochemical cell arrangement for use with the invention.

In practice, one may periodically provide samples of solutions X or Y to the sample chamber in the electrochemical cell of FIG. 3. To complete the cell, solution A or B is added to the reference chamber as shown. Test electrode 50 and reference electrode 60, (both, for example, platinum) when immersed in the sample and reference solutions respectively, provide a current path interrupted by a high impedance voltage comparator (shown). To close the current path, a porous plug 80, is provided in partition 90. When the potential between the sample and reference exceeds, or falls below, whichever the case may be, a certain preselected voltage level, an error signal is generated which triggers a suitable error display — alarm, flashing bulb, etc. — as shown. Or, in lieu of a voltage comparator, a voltmeter similarly placed may be used. In either case, the voltaic response to the change in ratio of ferric to ferrous ion in sample solution X or Y is immediate and reliable.

Illustrative bleach-fix solutions from which reference solutions may be drawn have been suggested above (solution A or B). The invention, however, is not so restricted. For example, if a third or fourth, etc., silver recovery vessel is (are) provided in a series with the first and second such vessels, any one of the bleach-fix solutions discharging from such additional recovery vessels may be used as a reference solution for the electrochemical cell proposed. Or, the solution discharging from either of the problem regions may be fed continuously through a large airtight holding tank. When the problems described herein occur, the attending change in the ferric-ferrous ion ratio is damped by the large volume of solution held within the holding tank. Solution discharging from the tank, being insensitive to the onset of the problem being detected, is therefore useful as a reference solution in accordance with the invention.

In a presently preferred embodiment of the invention (FIG. 4), the bleach-fix reference solution in any of the insensitive regions described above is drawn therefrom and flushed past reference electrode 60 in the reference half-cell sensing region. This can be accomplished, for example, by establishing two parallel flows of bleach-fix solution in one of the insensitive regions, and inserting the reference solution sensing compartment into one of the parallel flows as a fluid connection therefore. After passing through the cell, the reference solution can be rejoined into a common flow of bleach-fix solution with the other parallel flow. Or, the reference solution sensing compartment can be arranged to accept the entire flow of bleach-fix solution in one of the insensitive regions. By flushing fresh bleach-fix reference solution through the reference sensing region, the half-cell potential of the reference solution is immunized against the effects of ionic drift through sintered plug 80 in partition 90. Accordingly, long term accuracy of the monitoring technique in accordance with the invention is provided.

Figure 4:
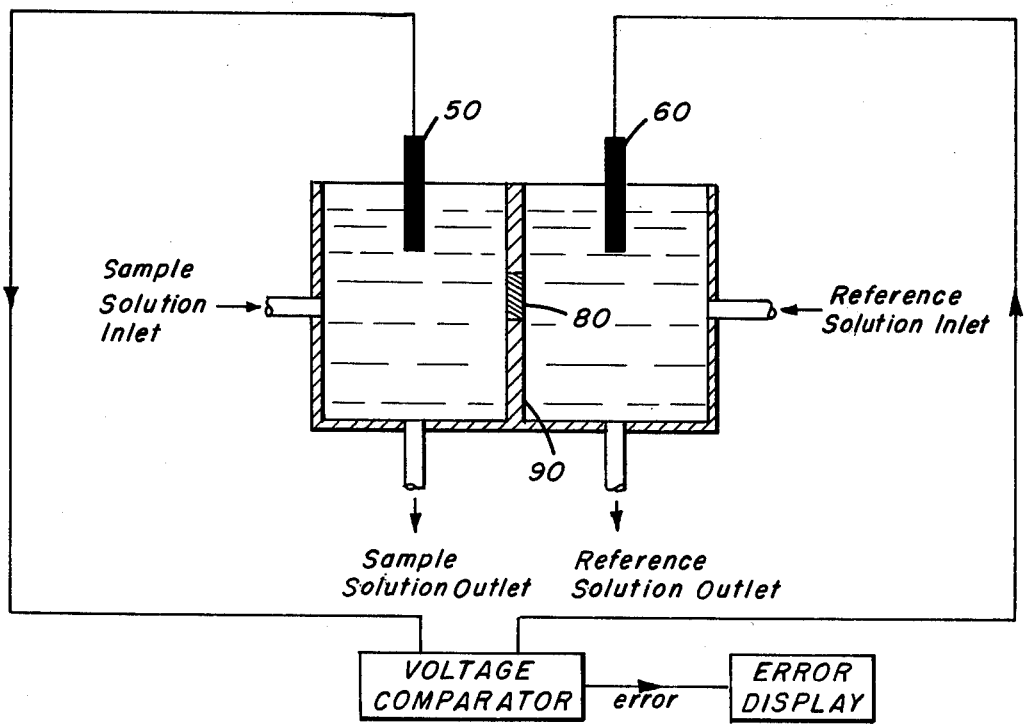
FIG. 4 is an electrochemical cell having a continuously flushing reference solution for use in accordance with the invention.

One skilled in the art will appreciate that in obtaining bleach-fix solution for use in the sample and reference sensing compartments of the electrochemical cell in accordance with the invention, some exposure of the solutions to air may be possible. Such exposure should be minimized or avoided lest the ferrous-to-ferric ion ratio in the solutions be disturbed. In this regard, use of the preferred embodiment illustrated in FIG. 4 is desirable; by establishing the sensing compartments in line with the bleach-fix regeneration cycle, the sensing compartments can be sealed as shown, thereby avoiding contact of the respective solutions with air.

The invention has been described in detail with particular reference to preferred embodiments thereof, but it will be understood that variations and modifications can be effected within the spirit and scope of the invention as described hereinabove and as defined in the appended claims.

What is claimed is:

1. In a process for regenerating a spent bleach-fix photographic solution to restore its bleaching capability and thereby permit its reuse in photographic processing, the bleaching agent being a ferric complex of an aminopolycarboxylic acid, the spent bleach-fix solution comprising silver ion and ferrous ion as a result of its use in a bleach-fix step of photographic processing which process of regeneration comprises in series a first silver replacement step in which silver ion in the spent bleach-fix solution is chemically replaced by reduction using elemental iron, and an oxidation step in which ferrous ion in the spent bleach-fix solution is oxidized to ferric ion;

the improvement comprising monitoring said regeneration process by electrochemically comparing the half-cell potential of the ferric-ferrous couple in a sample of the bleach-fix solution drawn from either said first silver replacement step or said oxidation step, with the half-cell potential of the ferric-ferrous ion couple in a reference solution drawn from a region of said regeneration process in which the bleach-fix solution is substantially insensitive to exhaustion of said elemental iron and insufficient oxidation, whereby either exhaustion of said elemental iron is detected when said sample bleach-fix solution is drawn from said first silver replacement step or insufficient oxidation is detected when said sample bleach-fix solution is drawn from said oxidation step.

2. The process of claim 1 further comprising a standby silver replacement step between said first silver replacement step and said oxidation step, and wherein said reference solution is drawn from the bleach-fix solution from either said bleach-fix step or said standby silver replacement step.

3. The process of claim 2 wherein said reference solution is drawn from the bleach-fix solution from said standby silver replacement step.

4. The process of claim 1 wherein fresh reference solution is flushed through a reference sensing region, whereby the reference half-cell potential is immunized from ions drifting between said reference and sample solutions.

5. The process of claim 4 further comprising a standby silver replacement step of iron between said first silver replacement step and said oxidation step, and wherein said reference solution is drawn from the bleach-fix solution from either said bleach-fix step or standby silver replacement step.

6. The process of claim 5 wherein said reference solution is drawn from the bleach-fix solution from said standby silver replacement step.

7. The process of claim 5 wherein an error display is caused when the comparison of said sample half-cell and reference half-cell potentials reaches a level indicative of elemental iron exhaustion or insufficient oxidation.

* * * * *

UNITED STATES PATENT OFFICE
CERTIFICATE OF CORRECTION

PATENT NO. : 4,065,313
DATED : December 27, 1977
INVENTOR(S) : Frederick L. Shippey It is certified that error appears in the above-identified patent and that said Letters Patent are hereby corrected as shown below:

Column 2, line 26, change "oxidising" to -- oxidizing --.

Column 4, line 52, after "back-up" insert -- for --.

Column 6, line 40, after "ferric-ferrous" insert -- ion --.

Column 7, line 6, before "standby" insert -- said --.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*